US007534306B2

(12) United States Patent
Kopel et al.

(10) Patent No.: US 7,534,306 B2
(45) Date of Patent: May 19, 2009

(54) STEAM HUMIDIFIER AND METHOD

(75) Inventors: Zev Kopel, Quebec (CA); Luc Briere, Québec (CA); Caroline Duphily, Québec (CA)

(73) Assignee: National Environmental Products, Ltd. (CA)

( * ) Notice: Subject to any disclaimer, the term of this patent is extended or adjusted under 35 U.S.C. 154(b) by 99 days.

(21) Appl. No.: 11/295,396

(22) Filed: Dec. 6, 2005

(65) Prior Publication Data

US 2006/0081271 A1 Apr. 20, 2006

Related U.S. Application Data

(62) Division of application No. 10/677,183, filed on Oct. 2, 2003, now Pat. No. 7,011,300.

(51) Int. Cl.
*F23J 1/00* (2006.01)

(52) U.S. Cl. ..... 134/19; 134/17; 134/26; 134/30; 134/34; 134/42

(58) Field of Classification Search ..... 134/19, 134/17, 26, 30, 34, 42
See application file for complete search history.

(56) References Cited

U.S. PATENT DOCUMENTS

| | | | | | |
|---|---|---|---|---|---|
| 2,602,644 | A | * | 7/1952 | Sandstrom | 165/84 |
| 2,874,112 | A | * | 2/1959 | Luckenbach et al. | 208/48 R |
| 3,332,477 | A | * | 7/1967 | Saunders | 165/76 |
| 4,158,438 | A | | 6/1979 | Hapgood | 237/7 |
| 4,203,392 | A | | 5/1980 | McLane | 122/17 |
| 4,768,495 | A | | 9/1988 | Zifferer | 126/101 |
| 4,951,648 | A | | 8/1990 | Shukla et al. | 126/21 A |
| 5,192,022 | A | | 3/1993 | Swenson | 237/2 B |
| 5,313,049 | A | | 5/1994 | Le Strat et al. | 219/444 |
| 5,439,372 | A | | 8/1995 | Duret et al. | 431/7 |
| 5,634,544 | A | * | 6/1997 | Bruner et al. | 194/226 |
| 5,666,910 | A | * | 9/1997 | George et al. | 122/40 |
| 5,816,496 | A | | 10/1998 | Kovacs | 237/78 R |
| 6,213,757 | B1 | | 4/2001 | Kushch et al. | 431/7 |
| 6,394,042 | B1 | | 5/2002 | West | 122/32 |
| 6,505,437 | B1 | | 1/2003 | Johnstone et al. | 47/1.44 |
| 2004/0007879 | A1 | | 1/2004 | Ruggieri et al. | 290/52 |

OTHER PUBLICATIONS

Honeywell CVI-vf Gas/Air Control Safety System Technical Spec, copyright, 2002, 4 pgs.
Acotech—Furigas Cylindrical Burner Technical Sheet, copyright 2002, 1 pg.
Acotech Metal Fiber Burners Technical Description, copyright 2002, 11 pgs. at www.acotech.com.

* cited by examiner

*Primary Examiner*—Sharidan Carrillo
(74) *Attorney, Agent, or Firm*—Robert C. Kain, Jr.

(57) ABSTRACT

The steam humidifier fed with a premix of natural gas and forced air under low pressure (less than 1 psi) includes a main frame, a movable lower frame, a two part evaporation canister, releasably sealed, for water, an immersible combustion chamber retaining a radiant gas burner and a heat exchanger coupled downstream thereto. The heat exchanger is a coil with an upstream end coupled to the combustion chamber and a downstream end mounted through the upper part of the canister. Maintenance is enhanced by having the lower part of the evaporation tank or canister move downwardly to expose the combustion chamber and the heat exchanger coils. The coils are subject to thermal shock or relatively rapid thermal expansion and contraction which causes scale, adhered thereon, to be released and broken off. A high degree of control and modulation is achieved because the radiant burner is configured for modulated operation from a blue flame mode through a radiant mode.

4 Claims, 5 Drawing Sheets

STEAM HUMIDIFIER AND METHOD

This is a divisional patent application based upon U.S. patent application Ser. No. 10/677,183, filed Oct. 2, 2003 now U.S. Pat. No. 7,011,300. The present application relates to a steam humidifier fed with low pressure natural gas (less than 1 psi).

BACKGROUND OF THE INVENTION

There is a need for a steam humidifier, which can be fed with low pressure natural gas, which is easy to maintain and which has a high degree of control or modulation. Commonly, premix natural gas burners are configured as a blue flame burner or are configured as a radiant burner. Further, natural gas radiant burners are typically not configured to operate in the blue flame range.

OBJECTS OF THE INVENTION

It is an object of the present invention to provide a steam humidifier which is easy to clean and maintain.

It is another object of the present invention to provide a steam humidifier which undergoes thermal shock to remove scale from the heat exchanger surfaces.

It is a further object of the present invention to provide a steam humidifier which has a high degree of modulation wherein the burner operates in both the blue flame mode and the radiant mode.

SUMMARY OF THE INVENTION

The steam humidifier burner is supplied with a premix of natural gas and forced air, the gas being supplied under low pressure (less than 1 psi). The humidifier includes a main frame, a movable lower frame coupled thereto, a two part canister for containing water wherein both parts are releasably sealed, a immerged combustion chamber within which is disposed a radiant gas burner and a heat exchanger coupled downstream of the combustion chamber and gas burner. The heat exchanger is a coil with an upstream end coupled to the combustion chamber and a downstream end mounted through the upper part of the canister. Maintenance is enhanced by having the lower part of the canister coupled to the movable lower frame which enables the lower part to be downwardly withdrawn from the upper part to expose the combustion chamber and the heat exchanger disposed in the canister. Maintenance is also enhanced because each loop of the coiled heat exchanger is spaced apart. By causing relatively rapid thermal expansion and contraction of the coiled heat exchanger, the heat exchanger undergoes thermal shock, which causes scale and debris, adhered thereon, to be released and broken off. The thermal shock results from either activation and then sudden deactivation of the gas burner without water in the canister or activation of the gas burner and sudden flooding of the canister with water substantially simultaneously with the deactivation of the gas burner. A high degree of control and modulation is achieved because the radiant burner is configured for modulated operation from a blue flame mode through a radiant mode.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a natural gas steam humidifier which is fed with gas under relatively low pressure (less than 1 psi).

Figure 1:
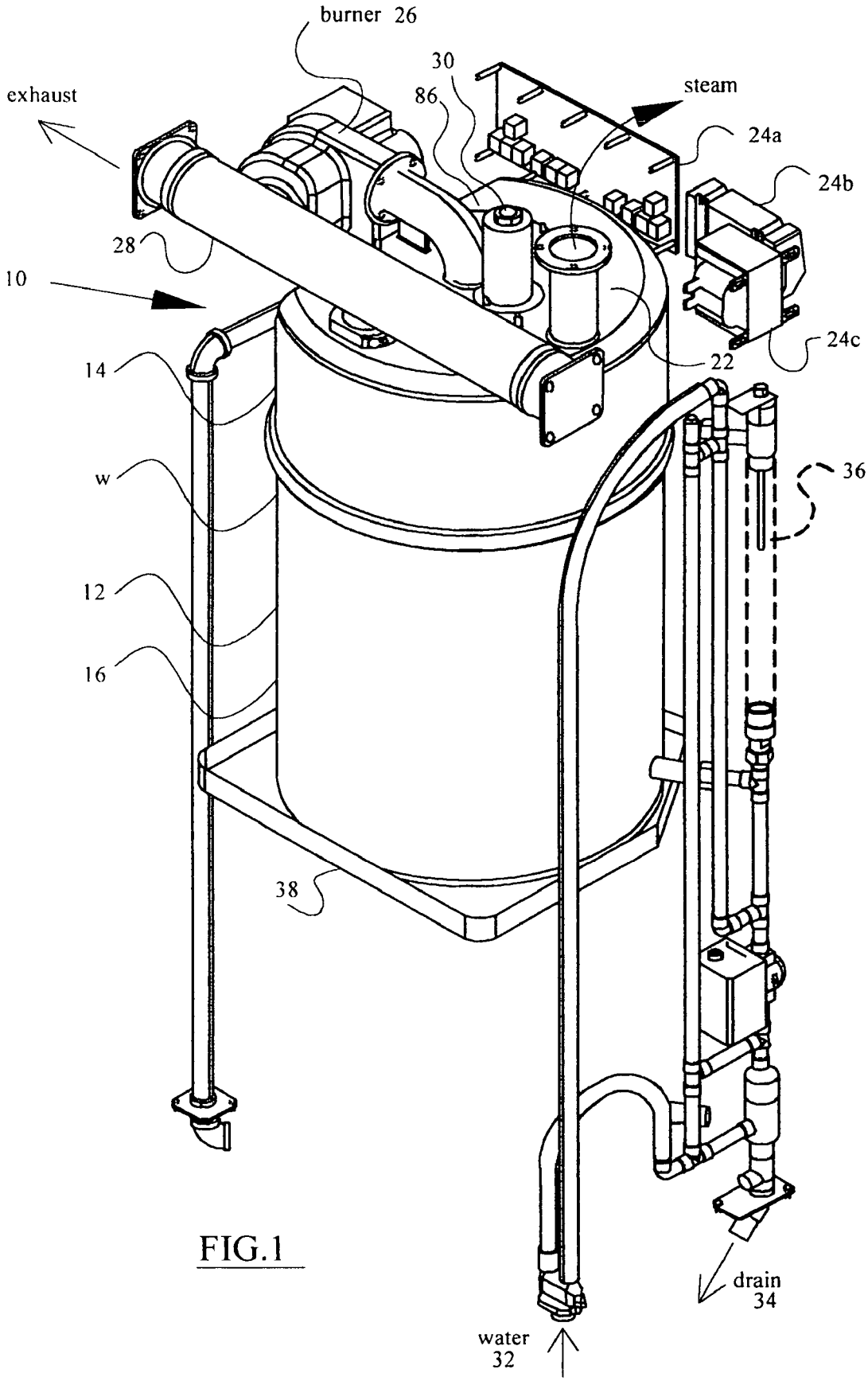
FIG. 1 diagrammatically illustrates a steam humidifier in accordance with the principles of the present invention.
Figure 2:
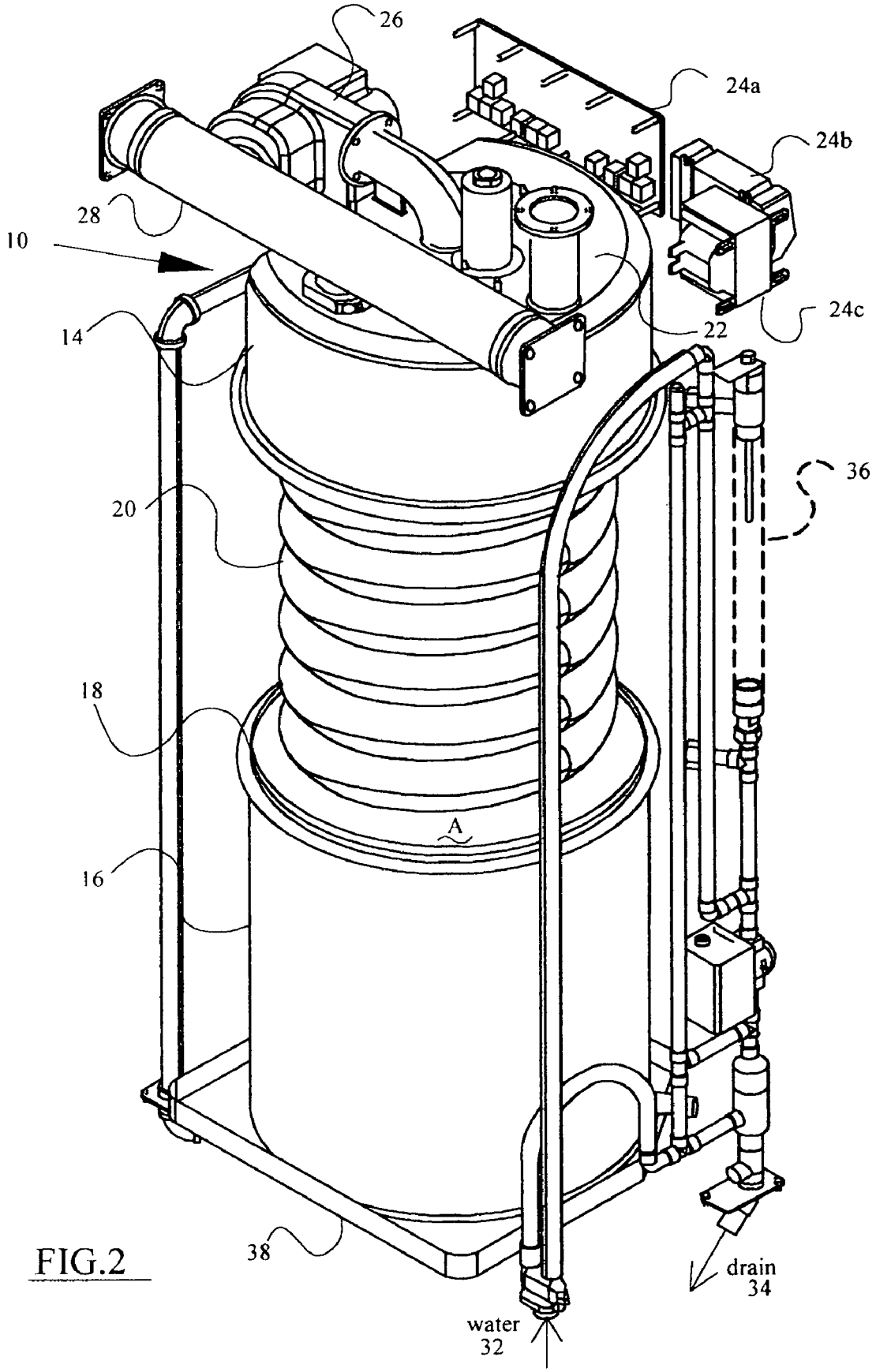
FIG. 2 diagrammatically illustrates the steam humidifier with the lower part of the canister withdrawn thereby exposing heat exchanger coils.

FIGS. 1 and 2 diagrammatically illustrate steam humidifier 10 with the two part canister 12 joined together (FIG. 1) and separated apart (FIG. 2) to permit maintenance of the unit. In FIG. 1, canister or evaporator tank 12 includes upper part 14 sealingly attached to lower part 16. Similar numerals designate similar items throughout the drawings. Lower portion 16 is sealingly attached to upper portion 14 via seal 18 (FIG. 2). This seal maybe an o-ring set in a channel in lower part 16 of canister 12. The two canister parts 14, 16 are attached together via some type of circumferential clamp which operates to compress seal 18 and the lips on both parts 14, 16. In FIG. 2, heat exchanger 20 is disposed in interior A of canister portions 14, 16. Canister 12 is adapted to retain water to be boiled by the burner mechanism and this water is typically maintained at level W shown FIG. 1. Steam exits the interior area A of canister 12 via port 22 shown in FIG. 1. Several components of the control electronics, components 24*a*, 24*b* and 24*c*, are shown in FIGS. 1 and 2. Gas burner operates on a premix of air and gas and includes a gas-air mix blower 26. Exhaust gas is removed and piped from the system via exhaust 28. A sight glass 30 permits an operator or technician to view the flame from the burner. Water is supplied to the system via water supply 32 and water is drained from the system via drain 34. A water level detector 36 is diagrammatically illustrated in FIGS. 1 and 2. Other types of water detectors could be utilized. Lower portion 16 of cannister 12 is mounted on a movable lower frame 38. The upper portion 14 is fixed to the main frame.

FIG. 2 diagrammatically illustrates lower frame 38 being moved lower such that lower portion 16 of the canister exposes all of heat exchanger coils 20. This full exposure of heat exchanger coils 20 enables the technician to clean and view all heat exchanger coil. Lower canister portion 16 can be laterally withdrawn from beneath the coils 20.

Figure 3:
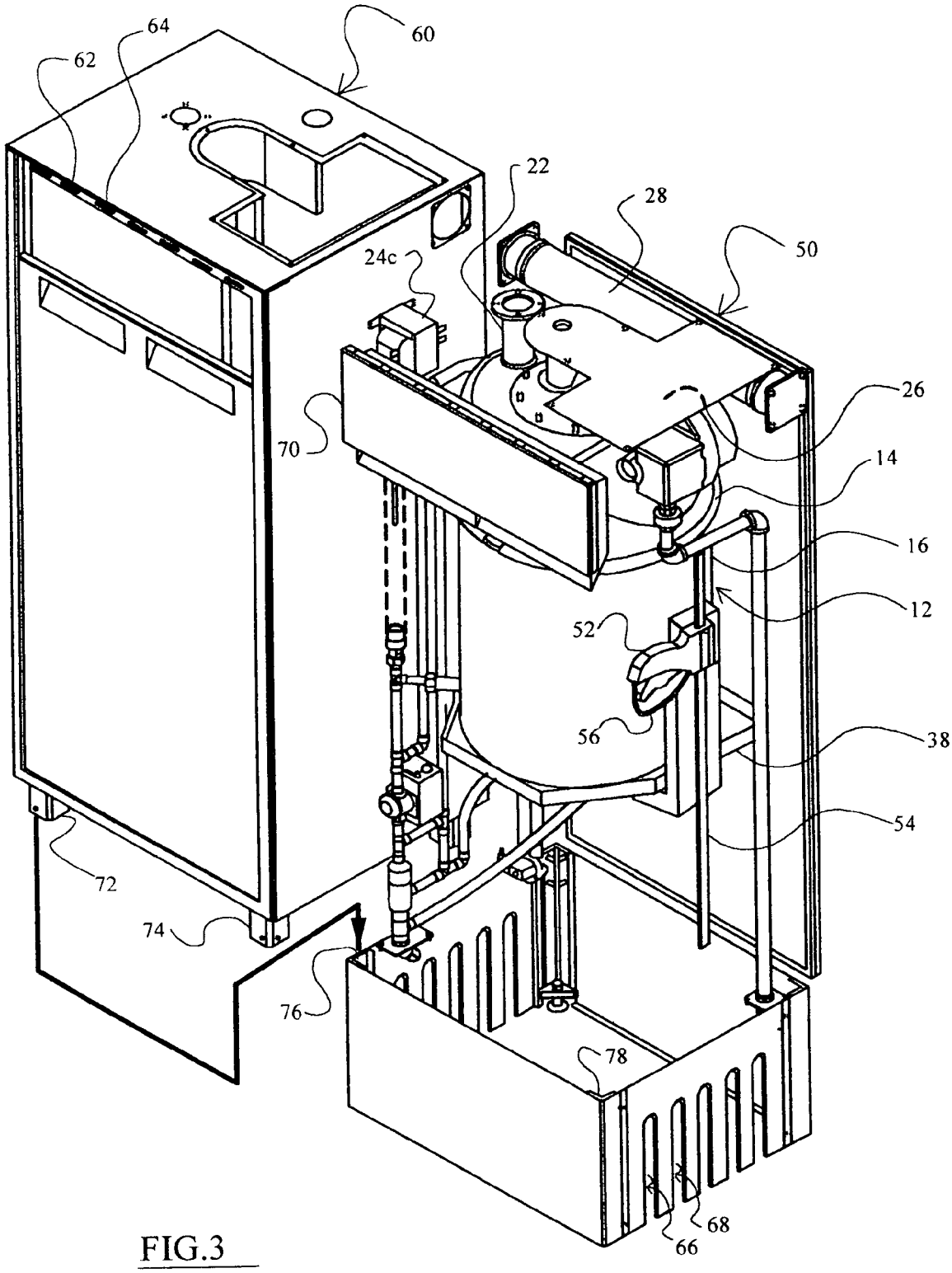
FIG. 3 diagrammatically illustrates the steam humidifier and the mechanism to lower the lower canister from the upper canister.

FIG. 3 diagrammatically illustrates evaporator tank or canister 12 mounted within a frame system 50 such that the upper part 14 of the canister 12 is mounted to the main frame 50. A movable lower frame 38 moves with respect to main frame 50. This action is accomplished by releasable latch mechanism 52 operating on guide bar 54. Guide bar 54 is attached to main frame 50. By depressing lever 56, lower frame 38, and hence lower canister portion 16, can be vertically dropped beneath heat exchanger coils 20 (FIG. 2). Other guide bars maybe used to stabilize the lower frame with respect to the upper frame. Additionally, FIG. 3 shows an enclosure 60 for the entire humidifier. Enclosure 60 includes a plurality of top level vent holes or slots, two of which are vents 62,64, in FIG.

3. Additionally, the enclosure has lower vent holes or slots, two of which are vents 66,68. Upper and lower vents 62,64, 66 and 68 provide convection cooling of the control electronics, one of which is shown as control electronic unit 24*c* in FIG. 3. Any heat generated by the controls rises and pulls cool air from vents 66,68. The other control electronic units on board 24*a* in FIG. 1 are disposed immediately behind tilt-out panel 70. Enclosure 60 has several legs, two of which are legs 72,74 which cooperate with leg brackets 76,78 to mount enclosure 60 onto main frame 50.

Figure 4:
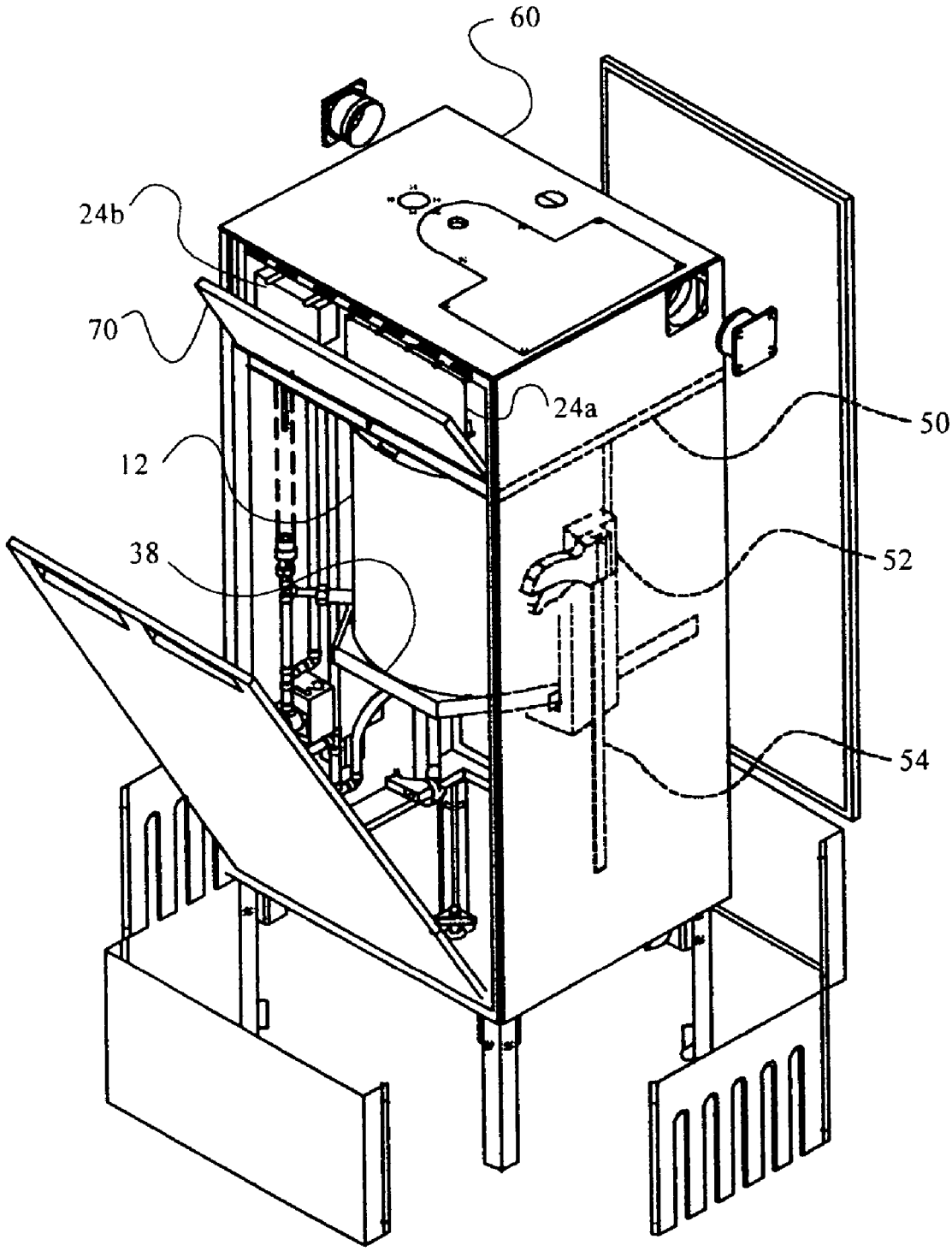
FIG. 4 diagrammatically illustrates the heat exchanger with control electronics and vents therefor.

FIG. 4 shows enclosure 60 mounted about main frame 50. Further, main frame is coupled to guide 54 of release system 52. Tilt-out panel 70 for electronics 24*a*, 24*b* is also diagrammatically illustrated in FIG. 4.

Figure 5:
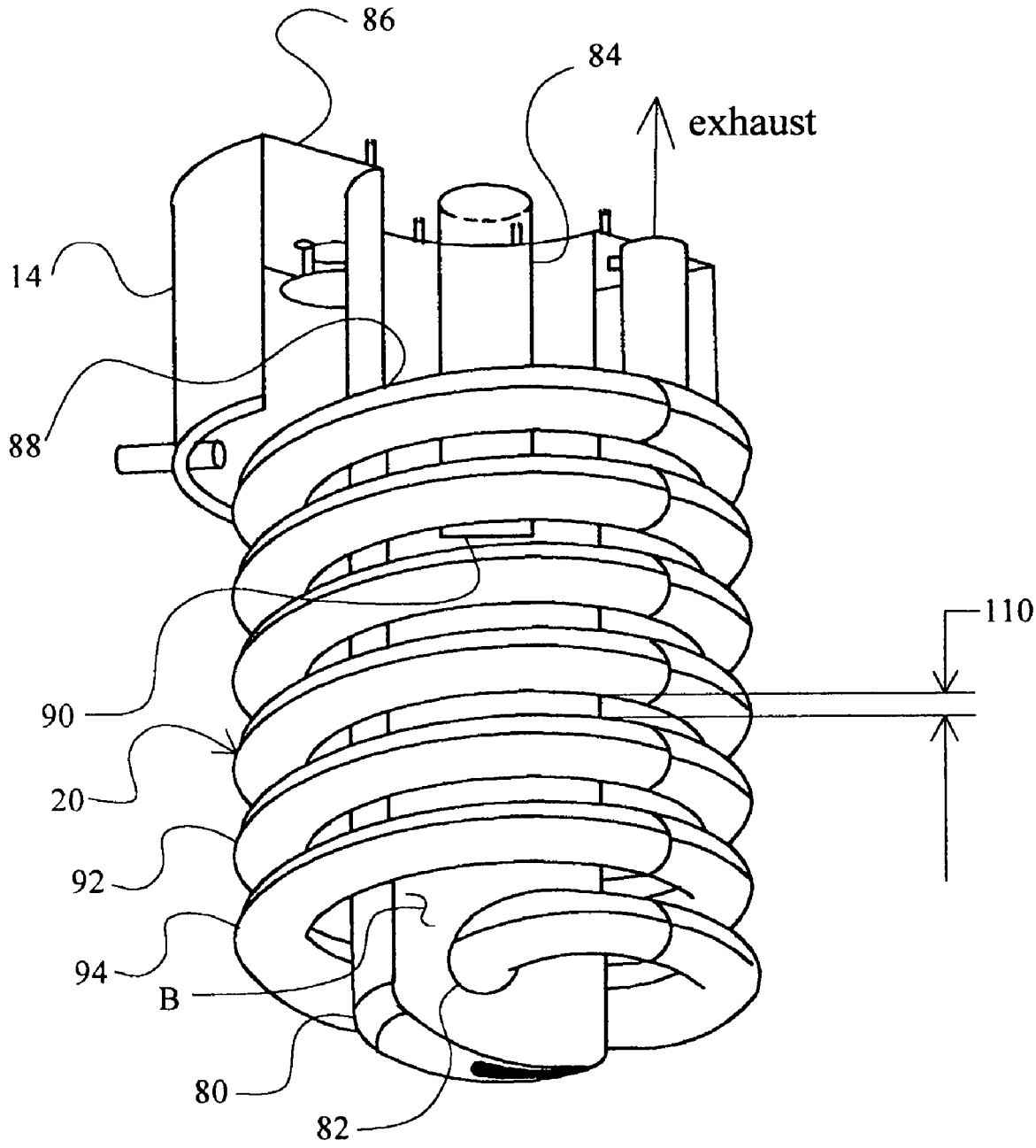
FIG. 5 diagrammatically illustrates the heat exchanger and the burner; and The thermal shock parameters are described later.

FIG. 5 diagrammatically illustrates heat exchanger 20 and a partial cut-away view of combustion chamber 80. Heat exchanger 20 has an upstream end 82 or coil start end which is attached at a right angle to a lower section of combustion chamber 80. Chamber 80 is cylindrical with a slightly rounded bottom. A radiant burner 84 is mounted to top cover 86 of upper canister part 14. Radiant burner 84 extends approximately 30% into combustion chamber area B. The annulus formed between the distal end of burner 84 and the inner surface 88 of combustion chamber 80 establishes a choke or restriction for flue gas as the flue gas or gases leave burner 90. Further, the coil of heat exchanger 20, two sections of which are identified as coils sections 92 and 94 in FIG. 5, are spaced apart in order to permit relatively rapid thermal expansion and contraction to establish a thermal shock. The downstream end of heat exchanger 20, not shown in FIG. 5 but coupled to the inboard end of steam output port 22 in FIG. 2, is only attached to and mounted through cover plate 86 of top portion 14 of the evaporation canister. With this coiled, spaced apart feature and the two mounting points (at upstream end 82 and the downstream end at port 22), thermal expansion and contraction is permitted. Space 110 between each respective coil of heat exchanger 20 and the limited coupling at upstream end 82 and the downstream end near steam output port 22 enables the entire heat exchanger to rapidly expand and contract. This thermal shock due to rapid expansion and contraction causes debris, such as scale, which cakes on the heat exchanger 20 during normal usage, to be loosened and sometimes broken off. The details of one working embodiment of the steam humidifier of the present invention follow.

Burners

In one embodiment of gas fired humidifier, two different metallic fiber radiant burners from the same manufacturer can be used. (1) Furigas, Model No. CDT 09072001.ppt, 228 mm long and 50 mm in diameter; (2) Acotech, Model No. CDT 09072001 Acotech.ppt, 8 inches long and 2 inch diameter.

Gas Train

With the burner 84, a gas train 26 is used, composed of Honeywell controls, gas valve and venturi and EBM's gas-air mix blower. This system is commercially marketed as the Honeywell CVI-vf and provides a fully integrated, well packaged, modulation capable system.

The gas train components are:

(1) VK8115F1001 Honeywell valve (2) 45900400—132 B Honeywell connector (3) 45900444—104 B Honeywell gasket (4) 45900441—015 B Honeywell wiring (5) S8910 U <<C >> Honeywell electronic ignition, flame and gas valve control (6) RG148-1200-3633 EBM blower and electric motor.

Combustion Chamber Characteristics

The present humidifier 10 has a small footprint. The humidifier is easy to maintain by using an innovative immerged combustion chamber 80 and heat exchanger 20 design.

The design uses a fully immersed combustion chamber, that is, a combustion chamber 80 substantially fully emerged in the evaporator water. The combustion chamber 80 has a cylindrical shape, mounted to the evaporation reservoir cover 86. The evaporator reservoir 12 is sometimes referred to herein as the humidifier tank or canister. In one embodiment, the combustion chamber 80 is 27.5 inches long and has a 7.5 inch diameter. The top part of the chamber 80 has a removable cover. The bottom part is rounded (FIG. 5) to prevent entrapping steam that would cause overheating of the combustion chamber. An earlier version of chamber 80 used a flat bottom which sometimes resulted in overheating. The combustion chamber 80 is positioned centrally in a cylindrically shaped evaporation tank 12.

The heat exchanger 20 is made of a thin wall stainless steel tube of 1.57 (1 and 19/32) inches ID (inside diameter) and 1.75 inches OD (outside diameter) and is 20 ft long. The heat exchanger 20 is connected to the bottom of the combustion chamber 80, horizontally at right angle from the combustion chamber wall. The heat exchanger 20 is wounded vertically in 6 coils of 13½ inches OD with ¾ inch space between each coil 92, 94 (space 110).

The cylindrical evaporation tank 12 is 30 inches high and has an 18 inch OD. The cover can be separated from the bottom. The cover joint is 8 inches below the top. The two (2) parts 14, 16 join together with a seal and an easily used locking mechanism. The seal maybe an o-ring in a channel formed on the lower part 16 of the canister-evaporation tank 12 which co-acts with lip or ledge on the upper part 14 of the tank. The cover 14 (top part of the canister) is slanted to provide room for a compact gas train 26. The combustion chamber 80 and heat exchanger 20 are made of an integral part of the cover 14. The water level W in the evaporation tank 12 is maintained below the joint between the upper and lower parts 14, 16 of the humidifier tank or evaporation tank 12. The cylindrical shape for this tank 12 was chosen in order to facilitate the sealing of the joint. The joint is needed in order to facilitate removal of the bottom part of the tank for cleaning.

The gas burner 84 is lowered 9½ inches into the combustion chamber 80 (about ⅓ of the distance into the combustion chamber) in order to ensure that the burner 84 is always under the water level W and that all the heat is transmitted to the water. The 9½ inch gap is filled with insulating material.

Modulation

A modulation range of 13,800 Btu/h to 142,800 Btu/h or 10.3 to 1 burner input is achieved with satisfactory combustion characteristics and stability. Combustion characteristics are deemed acceptable when the carbon monoxide (CO) and nitrous oxide (NOx) levels are lower than 100 ppm. The present burner achieved much lower levels than the deemed maximum gas emission levels. Stability is achieved when combustion characteristics do not change over time. Generally, combustion is stable at high input rates and becomes unstable at a lower inputs (12,000 Btu/h was achieved with the present unit but was found to have erratic characteristics).

Since steam production is achieved at a constant temperature (212 F.; 100 C.) for all gas burner inputs within the range, heat losses through the evaporation tank remain constant. As input is reduced, the ratio of energy loss to energy used becomes more important. This situation causes the steam production modulation to be larger than the burner modulation. A 6.2 lbs/h to 107.2 lbs/h or 17 to 1 modulation ratio for steam output is achieved with the present system.

Testing showed that the burner modulation range was affected by the combustion chamber geometry and by the combustion gas flow restriction (or back pressure) generated by the combustion chamber and heat exchanger. The burner used was capable of a 6 to 1 modulation in "free air" (without any restriction) and better than 10 to 1 in the combustion chamber. Similar observations were made with other burners. The present combustion chamber/heat exchanger combination generates 3.85 inches of W.C. positive pressure at the base of the burners.

One characteristic effecting modulation is the distance between the burner's surface and the combustion chamber's wall. The distance is 5 to 6 times the free air flame height. In one embodiment, a 2¾ inch gap is employed for ½ inch flame. This spatial relationship is needed to ensure that the flame will not come into contact with the combustion chamber's relatively cold wall. Such flame impingement cools down the flame and potentially stops the combustion process, causing bad combustion characteristics. Too large a distance and the backpressure generated in the combustion chamber is reduced, affecting the burner's modulation range.

The backpressure itself is generated by two characteristics: (i) by a restrictive passage for combustion gases between the burner 84 and the combustion wall 88; and (ii) by head loss due to friction in the heat exchanger 20. If one considers the free flue gas passage space and the annulus shaped at the end 80 of the burner 84 (between the burner and the inner wall 88 of the combustion chamber 80), a ratio of the burner surface to the annulus cross section of 2 to 1 provides the needed restriction. In the present case, the burner's surface is 50 sq. in. while the annulus' cross section is 24 sq. in. thus the annulus creates a 2 to 1 "choke" reducing the flue gas' speed which in turn increases the back pressure.

Head loss by friction is related to the gas speed; the faster the gas flow, the more head loss. Heat transfer, between the flue gases and the metallic inner surface of the heat exchanger, is related to gas speed, that is, the faster the gas, the more turbulent the gas flow and the more heat exchange is enabled. A gas speed of 3000 to 4000 ft/min is needed to ensure good heat transfer and obtain the required head loss (back pressure).

Radiant and Blue Flame Combustion

For the present gas humidifier combustion system, a natural gas premix radiant burner is used instead of a standard blue flame burner. In several cases, for example in applications like radiant heating or drying, a radiant burner is used for its radiant property. In the present case, a radiant burner was chosen for its modulation potential, rather than its radiant capacity. This use of a radiant burner for a gas fed steam humidifier (i.e. modulation potential) is innovative.

Historically in prior art systems, modulation was only possible with large input capacity natural gas burners. Natural gas radiant burners with small input capacities allow for a greater degree of modulation potential even under low gas supply pressures. Low gas supply pressures are typically less than ½ psi, in contrast to the gas pressures in industrial and large commercial buildings, which gas supply pressures are much higher, for example from 2 psi up to 60 psi.

The present humidifier 10 is a low pressure gas supply humidifier. The increased modulation potential is particularly obvious when the burner operates in the blue flame mode in the upper part of its modulation range, and in the radiant mode when it operates in the lower section of its modulation range.

A standard blue flame burner can operate in the blue flame mode only, intrinsically meaning a narrower modulation range. Therefore, large input or high pressure radiant burners permitted greater modulation but these burners were never utilized in low pressure applications.

The blue flame mode refers to the operating range where enough air-gas mixture velocity is provided to the burner (high flow rate, high capacity) to position the burner flame just above the radiant material. A blue flame is then formed over the mat surface and no radiant material heating occurs since the air-gas mixture that goes through it cools the radiant material. Modulating down the burner capacity, the air-gas mixture velocity decreases and the flame position gets closer and closer to the radiant mat. At a certain point, the flame reaches the burner surface and extinguishes in the case of a standard blue flame burner, or enters the radiant material in the case of a radiant burner, heats the radiant material (stainless steel wire in the present case) (other materials may be used) and causes it to radiate. That operating condition is the limit of the radiant operating mode.

Starting from that radiant mode upper limit and decreasing the burner capacity, the radiant material will go through bright yellow to cherry red phases, prior to the point of extinguishment when its lower modulation range limit is reached. At that point, the flame has been brought to the radiant burner inner metallic structure composed of a perforated metallic cylinder just like a standard blue flame burner. The perforations have very small diameters and, as the flame comes close to a perforation, the flame becomes quenched by the metallic cylinder and is extinguished. While operating in a radiant mode, this type of burner shows a greater potential for modulation because of the combustion stability provided by the heating capacity of the radiant material, allowing for a better flexibility in air-gas flow rate and than in burner capacity.

A low operating pressure natural gas premix radiant burner is well suited to be utilized with the present gas humidifier, to allow a high flexibility regarding water vapor production rate.

Also, surface combustion burners, such as radiant burners, are recognized for their low carbon monoxide (CO) and low nitrogen oxides (NOx) emission characteristics.

Scalability of the Design

The present invention evolved from the need to provide the largest modulation range for a gas supplied humidifier.

A gas train is a mechanism that controls the gas flow and ensures that the proper amount of combustion air is mix with the gas in order to obtain a good combustion. Gas trains capable of large modulation ranges are commercially available. They normally have the following characteristics: gas is supplied to the unit at a high pressure such that a mechanical valve will be effective in throttling and controlling the gas flow (gas at a high pressure with a small orifice works best), and a blower which generates a flow of combustion air that is mixed with the gas. The mixture is forced to the tip of a tube where it is ignited. There is some kind of linkage (mechanic or electric or electronic) between the opening of the gas orifice and the flow of combustion air (control for blower speed or some sort of damper). Systems which require a high gas supply pressure are not "normally" available in small commercial, institutional or light industrial buildings. Furthermore, they are normally bulky.

Metallic fiber radiant burners offer a possibility of wide range modulation. They can be custom made and their capacity is directly related to the burner surface. They can be made available for very small input rating and up to 2,000,000 Btu/h rating, which would be sufficient for a 1,500 lbs/h humidifier. Therefore, a low pressure, radiant premix gas burner humidifier, as described herein, can be configured to generate a reasonable amount of steam.

With respect to its lower limits, because of heat loss through a metallic reservoir full of hot water at 212° F. and because the burner's capacity can be tailored to certain needs, a zero output could be achieved with a burner operating at its lower limits. For the present design, with a 10 to 1 burner modulation range, a burner with a maximum rated input of 70,000 Btu/h could provide a steam capacity range of 0 to 50 lbs/h.

The present design can be scaled from a machine with a 0 steam production with a burner burning to 1500 lbs/h capacity.

It is not common practice to use an evaporator as described herein for large humidification needs. When larger humidification capacity is needed for a building, it is generally more efficient to use an off the shelf steam boiler with its associated water treatment than to use a large evaporator. Use of a boiler provides pressurized steam that is easier to distribute through a building and the transportable steam can also be used for heat and hot water production.

Several design ratios where developed in conjunction with the present invention. First, the metallic fiber burner's modulation range, when properly used, is better than 10 to 1. Off the shelf modulating gas trains also have a modulation range of 10 to 1. Second, in order for the metallic fiber burner to achieve a 10 to 1 modulation range, the combustion chamber must be at a higher pressure than the ambient pressure existing at the flue gas outlet. It was found that with this particular design, the pressure had to be from 1.5 to 4 inches W.C. Third, the ratio of the distance between the burner's surface and an emerged combustion chamber wall to the "open air" burner's flame height is 5 or 6 to 1. Four, the burner's surface to the annulus' surface ratio (choke ratio) is 2 to 1. Five, the heat exchanger's tube has a minimum-bending radius that is a function of the tube thickness and of the tube diameter. For the type of thin wall heat exchanger used in the present design, this bending radius is typically of 5 diameters. Six, the minimum speed of the flue gases in the tube heat exchanger is a consideration. As mentioned for the described design, the flue gas speed at the humidifier outlet is 3000 to 4000 ft/min. Slower speeds would reduce the heat exchange rate between the flue gases and the heat exchanger wall. Faster speeds increase the backpressure without any improvement on modulation range or heat exchange rate. Actually, the maximum burner's input would be reduced.

The following parameters were considered important in determining the design characteristics. (a) The heat transfer, discussed above, between the flue gases and the heat exchanger surface is related to speed, but is actually related to the Reynolds number. However, the system uses the same fluid. Flue gases from natural gas combustion have an average exhaust temperature of 280° F. that is consistent with an appliance having 82% to 86% efficiency. Accordingly, the Reynolds number was not accounted for, but the design parameters are a ratio of speed to length of the tube heat exchanger and all other Reynolds' parameters are considered to be constant. This ratio has to be 120 ft./sec./ft. to 180 ft/sec./ft. (V/L). However, this ratio alone is not sufficient. (b) Further, the diameter of the heat exchanger tube also plays a role in the heat transfer. The larger the diameter, the more flue gases will pass through the center of the tube, away from the wall. Therefore, the heat exchanger will need a longer tube. The length to diameter ratio should be kept between 150 ft/ft to 250 ft/ft (L/D ). By combining the previous Reynolds' ratio to this Length/Diameter ratio, it is possible to determine the length and diameter requirements to maintain optimum flue gases speed. (c) Flue gas speed at the appliance outlet should be kept between 3000 ft/min. to 9000 ft./min.

The thermal shock uses the difference in thermal expansion characteristics of the heat exchanger material and deposited scale to dislodge the accumulated scale from the surface of the heat exchanger. The thermal shock process requires that the heat exchanger be heated to a specific temperature than cooled down to ambient temperature. Time required to heated up or cool down is not a factor.

In operation, the heat exchanger length remains fairly constant because the working temperature of the appliance remains fairly constant (water in the evaporator remains at 210° F.) and scale heated at the same working temperature is deposited on the heat exchanger surface. By heating and cooling the heat exchanger, the relative length of the heat exchanger will be different than the relative length of the deposited scale.

It was found that for practical reason related to the combustion gases evacuation vent maximum working temperature, that the heat exchanger can be heated to a maximum flue gas temperature of 390° F. (200° C.). It was also found that passing from ±310° F. (155° C.) to 100° F. (38° C.) or less was sufficient to achieve a sufficient thermal shock to insure scale removal from the heat exchanger.

The method for applying a thermal shock to a steam humidifier having a gas burner with a forced air flue is also discussed herein. As noted above, the steam humidifier has a canister of water, which water is to be evaporated as steam and a heat exchanger disposed within the canister and configured as a coiled chamber with spaced apart loops. The heat exchanger is coupled downstream of the gas burner and the forced air flue and has a downstream end mounted through the upper part of said canister. The method includes: (a) causing relatively rapid thermal expansion and contraction of the coiled chamber heat exchanger in the form of a thermal shock adapted to release scale adhered thereon; wherein (b) the aforementioned thermal shock results from either (i) activation and then sudden deactivation of the gas burner substantially without water in the canister (as explained earlier, water is normally present in the canister during normal operations) or, alternatively, (ii) activation of the gas burner substantially without water in the canister and then sudden flooding of the canister with water substantially simultaneously with deactivation of the gas burner. The thermal shock causes substantially sudden expansion and then contraction of said coiled chamber heat exchanger. Further, the method includes the step of separating the upper canister part from the lower canister part to permit cleaning thereof.

The claims appended hereto are meant to cover the scope and spirit of the present invention. The details regarding the current working embodiment of the present invention are not meant to limit the scope of the invention set forth in the claims but are illustrative of features of the invention.

What is claimed is:

1. A method of removing scale from a heat exchanger of a steam humidifier, said steam humidifier having a gas burner with a forced air flue, said steam humidifier having a canister holding water to be evaporated as steam, said canister having an upper canister part and a lower evaporator part, a combustion chamber disposed in said canister, said gas burner disposed within said combustion chamber and mounted in said upper canister part, a heat exchanger disposed within said canister and configured as a coiled chamber with spaced apart loops, said heat exchanger coupled downstream of said combustion chamber and said gas burner, the method comprising:

immersing said combustion chamber within which is disposed said gas burner in said water of said canister, draining the water from said canister, creating a thermal shock on said heat exchanger without water in the canister, said thermal shock resulting from activation and then deactivation of said gas burner, wherein both said activation and deactivation occurs without water in the canister, said thermal shock causing thermal expansion and contraction of said coiled chamber heat exchanger to remove scale adhered thereon.

2. A method as claimed in claim 1 including the step of separating said upper canister part from said lower evaporator part to permit cleaning thereof.

3. A method of removing scale from a heat exchanger of a steam humidifier, said steam humidifier having a gas burner with a forced air flue, said steam humidifier having a canister holding water to be evaporated as steam, said canister having an upper canister part and a lower evaporator part, a combustion chamber disposed in said canister, said gas burner disposed within said combustion chamber and mounted in said upper canister part, a heat exchanger disposed within said canister and configured as a coiled chamber with spaced apart loops, said heat exchanger coupled downstream of said combustion chamber and said gas burner, the method comprising:

immersing said combustion chamber within which is disposed said gas burner in said water of said canister, draining the water from said canister, creating a thermal shock on said heat exchanger without water in the canister, said thermal shock resulting from the steps of (a) activation of said gas burner without water in the canister followed by (b) flooding of said canister with water and (c) deactivating said gas burner, wherein the steps of (b) and (c) occur simultaneously, wherein said thermal shock causes thermal expansion and contraction of said coiled chamber heat exchanger to remove scale adhered thereon.

4. A method as claimed in claim 3 including the step of separating said upper canister part from said lower evaporator part to permit cleaning thereof.

* * * * *